US006155591A

United States Patent [19]

Huffman et al.

[11] Patent Number: 6,155,591

[45] **Date of Patent: *Dec. 5, 2000**

[54] ROTATABLE SNOWBOARD BOOT BINDING

[75] Inventors: William A. Huffman, 3100 Hass Dr., Aptos, Calif. 95003; Duncan S. Wade, Aptos; Mark D. Brinkerhoff, San Jose, both of Calif.

[73] Assignee: William A. Huffman, Aptos, Calif.

[ * ] Notice: This patent is subject to a terminal disclaimer.

[21] Appl. No.: 09/097,019

[22] Filed: Jun. 12, 1998

[51] Int. Cl.[7] ..... A63C 9/081

[52] U.S. Cl. ..... 280/618; 280/14.2; 280/607

[58] Field of Search ..... 280/14.2, 617, 280/618, 625, 633, 634, 636, 607, 629

[56] References Cited

U.S. PATENT DOCUMENTS

| | | | |
|---|---|---|---|
| 4,219,217 | 8/1980 | Gertsch | 280/629 |
| 5,125,173 | 6/1992 | Nagano et al. | 36/131 |
| 5,354,088 | 10/1994 | Vetter et al. | 280/618 |
| 5,356,170 | 10/1994 | Carpenter et al. | 280/618 |
| 5,499,837 | 3/1996 | Hale et al. | 280/607 |
| 5,505,477 | 4/1996 | Turner et al. | 280/613 |
| 5,520,405 | 5/1996 | Bourke | 280/613 |
| 5,520,406 | 5/1996 | Anderson et al. | 280/624 |
| 5,553,883 | 9/1996 | Erb | 280/607 |
| 5,577,755 | 11/1996 | Metzger et al. | 280/607 |
| 5,586,779 | 12/1996 | Dawes et al. | 280/14.2 |
| 5,667,237 | 9/1997 | Lauer | 280/607 |
| 5,713,594 | 2/1998 | Jenni | 280/624 |
| 5,762,358 | 6/1998 | Hale | 280/607 |
| 5,765,853 | 6/1998 | Erb | 280/607 |
| 5,803,481 | 9/1998 | Eaton et al. | 280/633 |
| 5,890,729 | 4/1999 | Bayer et al. | 280/618 |
| 5,897,128 | 4/1999 | McKenzie et al. | 280/607 |
| 5,941,552 | 8/1999 | Beran | 280/607 |
| 5,975,554 | 11/1999 | Linton | 280/607 |
| 5,984,325 | 11/1999 | Acuna | 280/14.2 |

FOREIGN PATENT DOCUMENTS 9749464 12/1997 WIPO .

OTHER PUBLICATIONS

PCT/US99/13299 Search Report mailed Sep. 7, 1999.

*Primary Examiner*—J. J. Swann
*Assistant Examiner*—David R. Dunn
*Attorney, Agent, or Firm*—Blakely, Sokoloff, Taylor & Zafman

[57] ABSTRACT

A boot binding that is easily and quickly rotatable between different positions is disclosed. In one embodiment of the invention, a boot binding comprises a rotatable boot attachment member and an intermediate locking arrangement that holds the boot attachment member in an intermediate position. A force applied to the boot attachment member releases the intermediate locking arrangement such that the boot attachment member can be moved from its intermediate position to a different position.

17 Claims, 11 Drawing Sheets

ROTATABLE SNOWBOARD BOOT BINDING

BACKGROUND OF THE INVENTION

1. Field of the Invention

The present invention relates generally to boot bindings, and more specifically to boot bindings for snowboards.

2. Background Information

Snowboarding requires the user to stand with both feet on the snowboard. Bindings on the snowboard secure the user's boots to the snowboard so that the user can adequately maneuver the snowboard. When riding the snowboard, the user's boots are bound such that they both point primarily toward one side of the snowboard. Unfortunately, when the user is on a flat area such as the path to a ski lift, it is difficult to create any forward movement because both of the user's boots are bound to the snowboard and poles are not used in snowboarding, unlike skiing. Thus, the user must release the back boot from its binding and push forward in the same way a skateboarder uses a free foot to achieve forward movement. The problem with this situation is that the user's front boot is still bound to the snowboard at an awkward angle. That is, the longitudinal axis of the user's front boot is substantially non-parallel to the longitudinal axis of the snowboard. Thus, as the user pushes the snowboard in a forward direction with the back boot, the user's front boot is pointing in a direction that is away from the movement of the snowboard.

Furthermore, when the user is sitting on a ski lift, the front boot is still bound to the snowboard while the back boot is free, causing one of the user's legs to twist at an uncomfortable angle as it dangles in the air. If two users are sitting next to each other on the ski lift, and they use opposite boots as their front boot, the twisting of their legs due to their respective bindings can cause their snowboards to collide with each other. This is not only irritating, but also potentially dangerous. Getting off a ski lift is also potentially troublesome because the angle at which the user's front boot is bound to the snowboard can make it difficult for the user to position the snowboard perpendicularly to the ski lift chair. If the snowboard is not positioned perpendicularly to the ski lift chair as the snowboard hits the ground, the user could veer off to one side and run into the person who had been sharing the ski lift.

The above mentioned problems affect all snowboard users, but beginning snowboard users are especially affected by such problems because they are unaccustomed to having their leg twisted at an awkward angle. When this awkwardness is coupled with the beginning snowboard user's overall inexperience with maneuvering and controlling a snowboard, the beginning snowboard user can be especially at risk to suffer an injury.

Thus, what is needed is a boot binding that is easily and quickly rotatable to and from different positions, thereby allowing the user to select a comfortable, safe and useful angle for the user's boot and leg.

SUMMARY OF THE INVENTION

Therefore, it is an object of the present invention to provide a boot binding that is easily and quickly rotatable between different positions.

It is a further object of the present invention to provide a boot binding that does not scratch the underlying snowboard when the boot binding is rotated or otherwise moved relative to the snowboard.

In one embodiment of the present invention, a boot binding comprises a rotatable boot attachment member and an intermediate locking arrangement that holds the boot attachment member in an intermediate position. The intermediate locking arrangement can be released upon the application of a first force to the boot attachment member such that the boot attachment member can be moved from its intermediate position.

In another embodiment of the present invention, a boot binding comprises a rotatable boot attachment member, an initial locking arrangement and an intermediate locking arrangement. The initial locking arrangement holds the boot attachment member in an initial position, and the intermediate locking arrangement holds the boot attachment member in an intermediate position. The boot attachment member is rotatable from its intermediate position back to its initial position upon the application of a swivel force to the boot attachment member.

In still another embodiment of the present invention, a boot binding comprises a boot attachment member that has a number of pads disposed on a bottom surface of the boot attachment member such that the pads engage the snowboard to which the boot attachment member is attached. The pads have a surface hardness less than that of the snowboard, which protects the snowboard against scratching when the boot attachment member is moved relative to the snowboard.

Additional features and benefits of the present invention will become apparent from the detailed description, figures and claims set forth below.

BRIEF DESCRIPTION OF THE DRAWINGS

Various embodiments of the present invention will be described in detail with reference to the following drawings in which like reference numerals refer to like elements. The present invention is illustrated by way of example and not limitation in the accompanying figures.

DETAILED DESCRIPTION

A boot binding is described. The description and accompanying drawings are for purposes of illustration and are not to be used to construe the invention in a restrictive manner.

In the following description, specific details are set forth, in order to provide a thorough understanding of the invention. However, it will be obvious to one of ordinary skill in the art that the invention can be practiced without these specific details. In other instances, well-known processing steps, methods, materials, etc. have not been described in particular detail in order to avoid unnecessarily obscuring the invention. The invention will be described with specific reference to snowboards, but it is appreciated that the invention is not limited to any one field of use.

The invention provides a boot binding having a rotatable boot attachment member that is moveable from a first radial position to a second radial position by the application of a swivel force created by the rotation of a user's foot, and hence, the user's boot. The boot attachment member is configured to hold the boot worn on the user's foot. The boot attachment member is held in the first radial position by a first locking arrangement, which is releasable upon the application of the swivel force applied by the user. The boot attachment member is held securely in the second radial position by a second locking arrangement. The first radial position can be the user's non-ride position, in which the user's boot is at a more comfortable angle for pushing the underlying snowboard forward on unsloped areas or for sitting on a ski lift. The second radial position can be the user's ride position, in which the user's boot is at a conventional angle for riding the snowboard down a slope. The invention allows a user who was initially in a ride position but then switched intermediately to a non-ride position, to switch back to the ride position without using his or her hands.

Figure 1A:
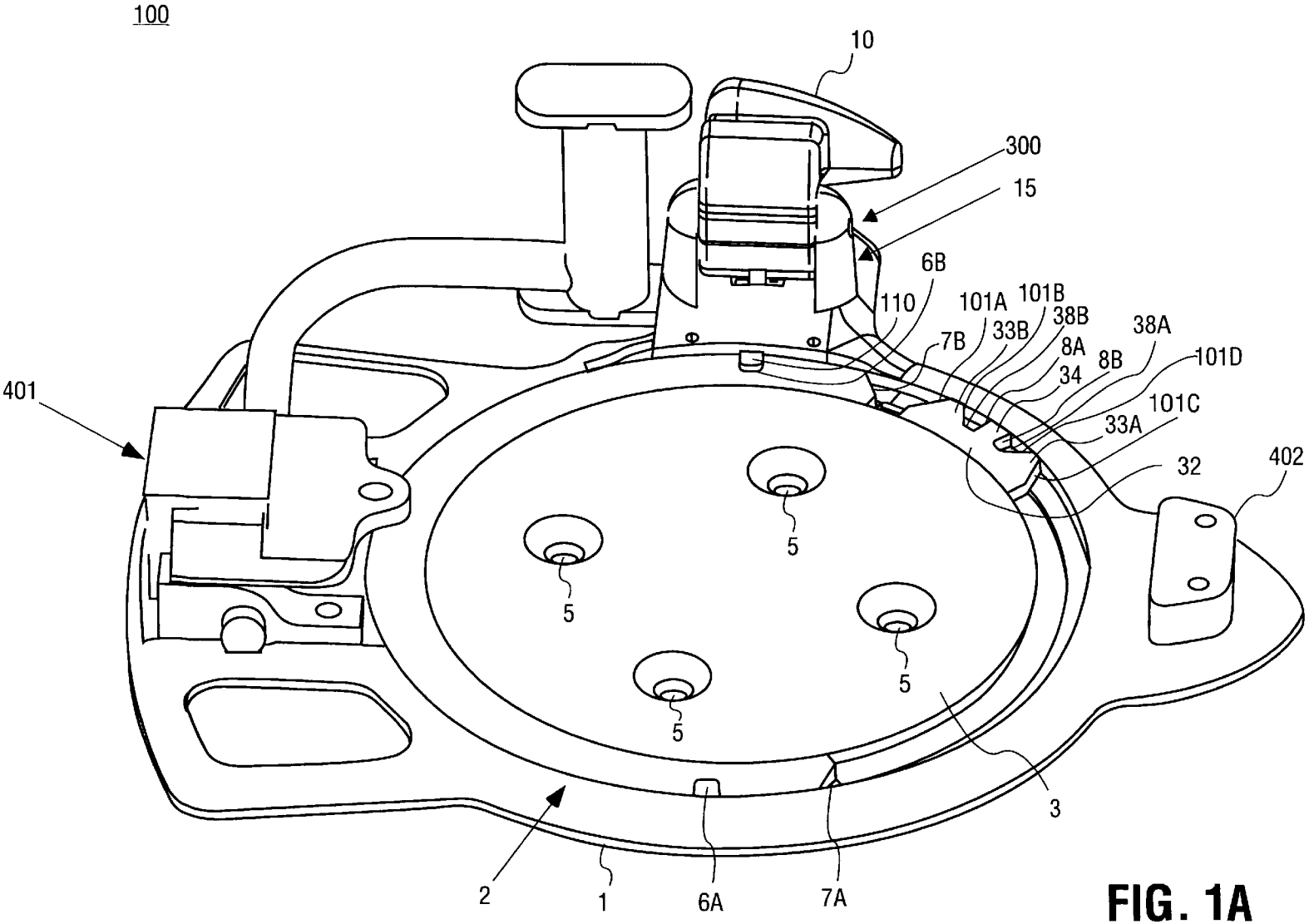
FIGS. 1A and 1B show an assembled boot binding in accordance with the teachings of the present invention.
Figure 1B:
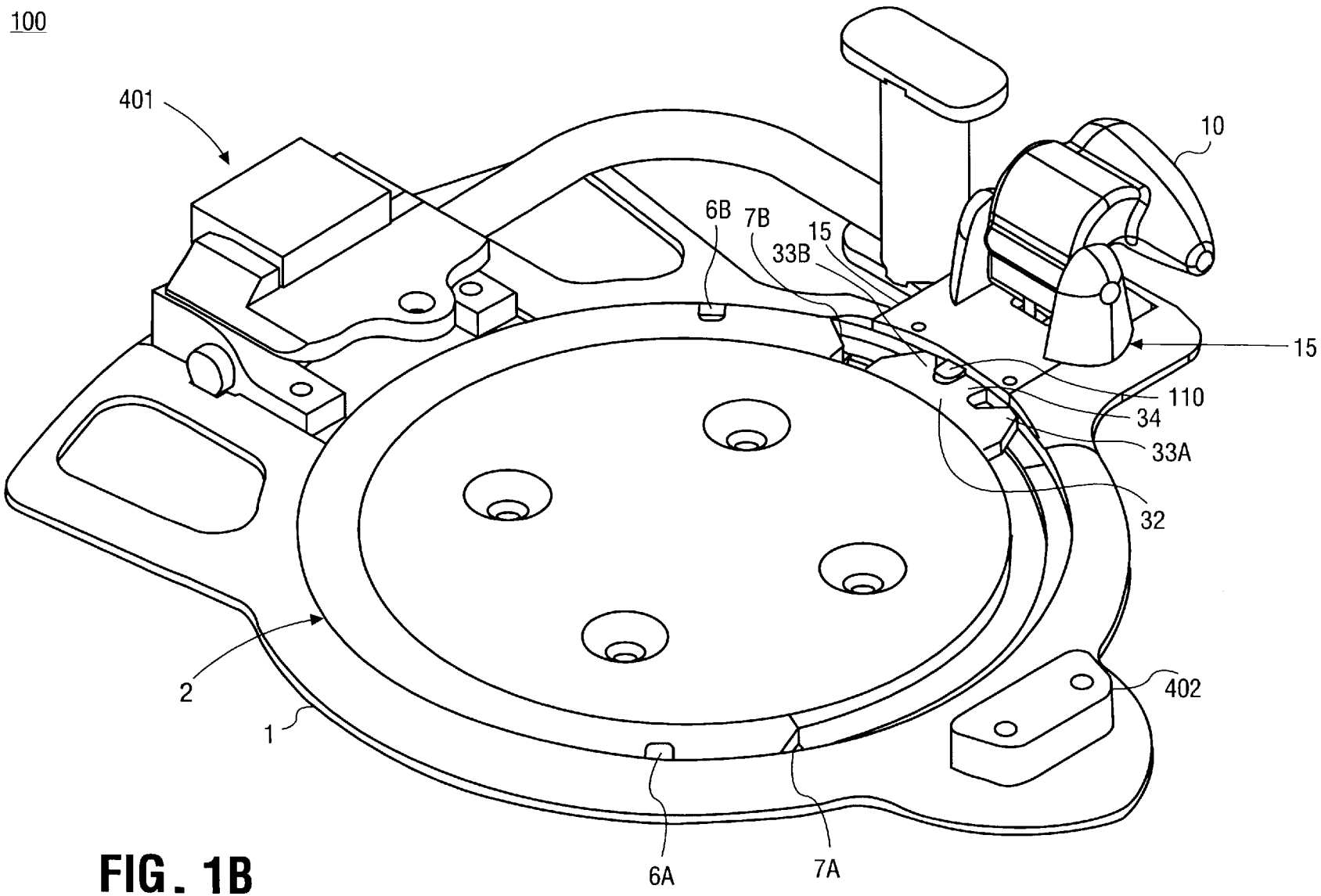
Figure 1C:
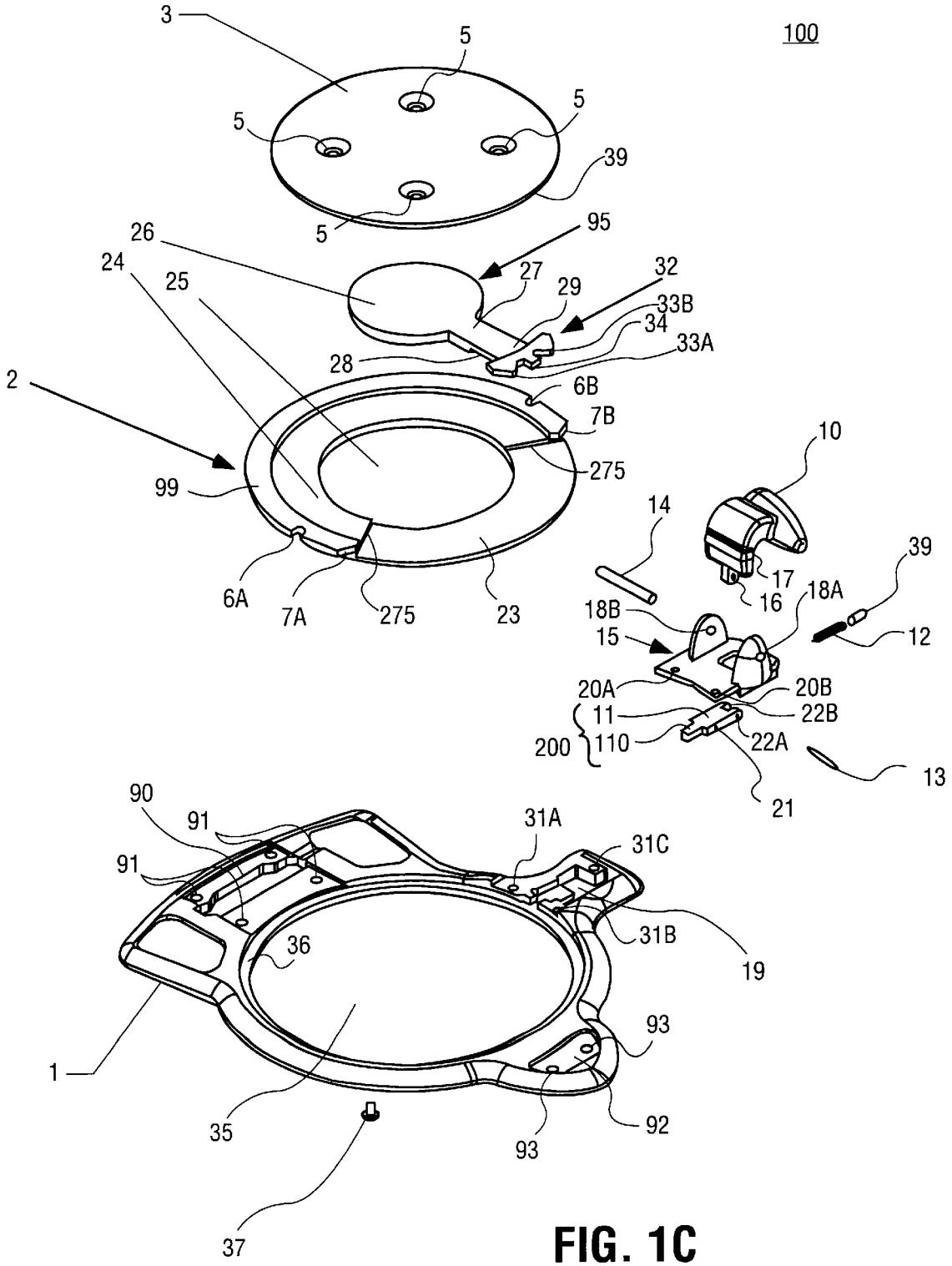
FIG. 1C shows an unassembled, expanded view of a boot binding in accordance with the teachings of the present invention.

FIGS. 1A, 1B and 1C show a boot binding assembly 100 in accordance with one embodiment of the present invention. Assembly 100 includes a boot attachment member 1 that is rotatable around a locking ring 2, which resides within an opening of boot attachment member 1. Boot attachment member 1 is shown having a heel clip 401 and a toe clip 402. However, it is to be understood that the invention is not limited to boot attachment members having such features. For example, boot attachment member 1 can be of the side clip type, center clip type, or boot shell type. A securing plate 3 is engageable with locking ring 2. Securing plate 3 has threaded bolt holes 5 which accept bolts (not shown) that extend through bolt holes 5 into matching bolt holes in a snowboard (not shown), thereby securing the boot binding to the snowboard. A stopping member 32 extends from a cam 95 located between locking ring 2 and securing plate 3. Stopping member 32 has two double-angled portions 33*a* and 33*b* that are separated by a stopping portion 34. In one embodiment, stopping member 32 is symmetric. Locking ring 2 has slots 6*a* and 6*b* for accepting a moveable tab 110 of a locking mechanism 300. Locking mechanism 300 includes a release arm 10 and a spring 12 that is positioned within a housing 15 by a plug 39. Tab 110 and a main body 11 define a locking member 200. Release arm 10 is coupled to housing 15 which shields main body 11 and spring 12. It is appreciated that main body 11 is not required. It is further appreciated that locking mechanism 300 can be located at any convenient location around the periphery of boot attachment member 1.

Boot attachment member 1 is locked in an initial position when an initial locking arrangement or locking assembly, comprising tab 110 mating with either slot 6*a* or 6*b*, is in effect. Tab 110 is forced into a locked position by spring 12 as described in more detail below with respect to FIGS. 5A and 5B. Spring 12 continuously biases main body 11, and hence tab 110, in an inward direction toward locking ring 2. In one embodiment, a wire segment inserted into a through hole 21 of main body 11 and having its ends secured to boot attachment member 1 is used instead of spring 12. In another embodiment, an elastomer member provides the biasing force. Release arm 10 is coupled to main body 11 to allow an opposing force to be applied to main body 11 such that tab 110 can be moved in an outward direction away from locking ring 2. The initial locking arrangement is released by a user pulling upward on release arm 10 to cause tab 110 to be withdrawn from either slot 6*a* or 6*b*. It should be noted that the invention is not limited to a tab-slot locking arrangement or assembly.

Figure 7:
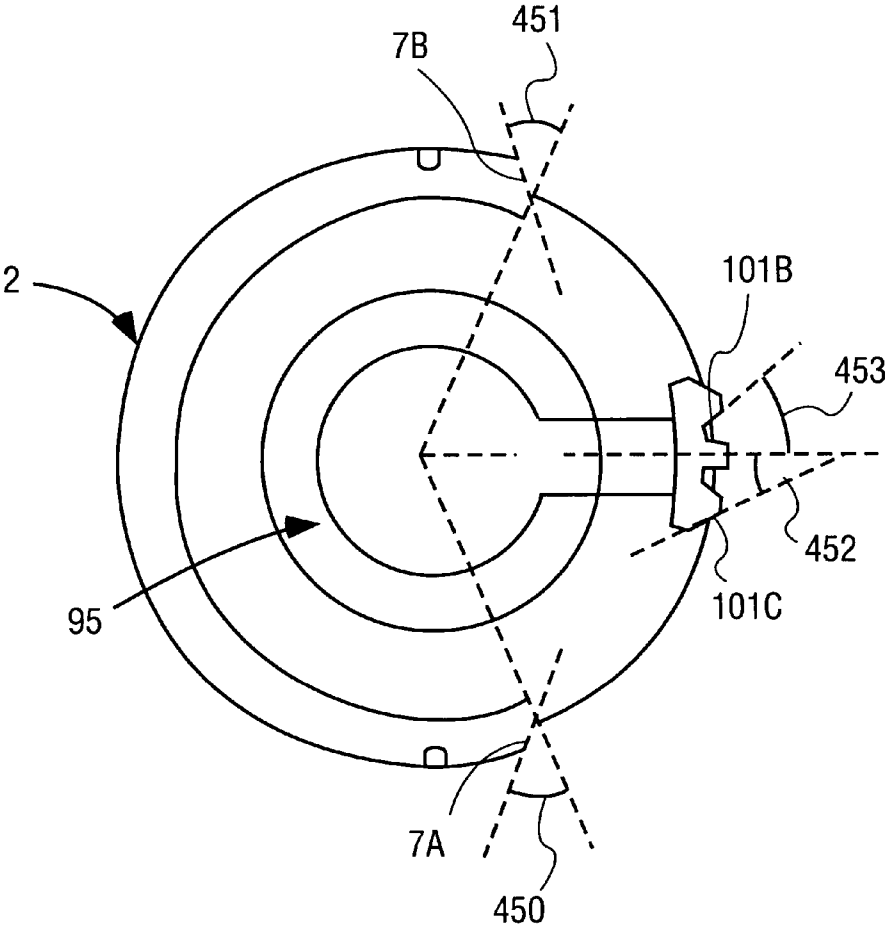
FIG. 7 shows several exemplary angles of positioning assembly components in accordance with the teachings of the present invention.

Once the initial locking arrangement is released, the user is able to rotate boot attachment member 1 by applying a swivel force to boot attachment member 1. This is typically accomplished by the user rotating a boot attached to boot attachment member 1. It should be noted that the boot binding shown in FIGS. 1A and 1B is configured for users who use their right boot as their front boot. The binding may be configured for users who use their left boot as their front boot. Once the user has rotated boot attachment member 1 enough so that tab 110 is beyond slot 6*b*, the user can release release arm 10 and continue to swivel boot attachment member 1 until tab 110 engages with stopping member 32 as shown in FIG. 1B. Double-angled portions 33*a* and 33*b* of stopping member 32 are angled with an outer slope 101*c* and an inner slope 101*d* and an outer slope 101*a* and an inner slope 101*b*, respectively, such that tab 110 can slide into a space 38*a* or 38*b* between double-angled portions 33*a* and 33*b* and stopping portion 34 when boot attachment member 1 is swiveled toward stopping member 32. The angle 452 (see FIG. 7) of outer slope 101*c*, as well as outer slope 101*a*, is normally in the range of 20–30 degrees. Outer slope 101*a* is measured in the same manner as outer slope 101*c*. The angle 453 (see FIG. 7) of inner slope 101*b*, as well as inner slope 101*d*, is normally in the range of 40–50 degrees. Inner slope 101*d* is measured in the same manner as inner slope 110*b*. In lieu of the user having to pull release arm 10 to overcome the force of spring 12, the user can now rely on the swivel force of the boot to overcome the force of spring 12 when tab 110 comes into contact with either outer slopes 101*a*, 101*c* or inner slopes 101*b*, 101*d*. The walls 8*a*, 8*b* of stopping portion 34 act to prevent further rotation of boot attachment member 1 by blocking the path of tab 110.

When tab 110 has reached stopping portion 34, boot attachment member 1 is in an intermediate position as shown in FIG. 1B. An intermediate locking arrangement or locking assembly comprises tab 110 engaging with spaces 38*a* or 38*b* of stopping member 32. Because of inner slope 101*b*, the user can use the attached boot to swivel boot attachment member 1 in an opposite direction (toward slot 6*b*) without pulling on release arm 10. The swivel force of the boot is enough to overcome the force of spring 12 and retract tab 110 whether the user is swiveling boot attachment member 1 to engage or disengage tab 110 and stopping member 32. It should be noted that the angles of outer slopes 101*a*, 101*c* and inner slopes 101*b*, 101*d* can be chosen to vary the swivel force required to engage and disengage tab 110 and stopping member 32. By having two double-angled portions 33*a* and 33*b*, stopping member 32 can accommodate any user regardless of which boot is used as the front boot.

As boot attachment member 1 is swiveled toward slot 6*b*, tab 110 comes into contact with a single-angled portion 7*b* of locking ring 2. Single-angled portion 7*b* is angled such that the swivel force applied to boot attachment member 1 is sufficient to overcome the force of biasing means 12 and retract tab 110 as tab 110 comes into contact with single-angled portion 7*b*. The angles 450 and 451 (see FIG. 7) of single-angled portions 7*a* and 7*b*, respectively, are typically in the range of 40–50 degrees. Once boot attachment member 1 is swiveled to slot 6*b*, tab 110 slides into slot 6*b* where tab 110 is locked, placing boot attachment member 1 back in its initial position. Thus, boot attachment member 1 can be rotated from an intermediate position back to an initial position by applying a swivel force to boot attachment member 1 via an attached boot. It should be noted that slot 6*a* and single-angled portion 7*a* are present to accommodate users who use the opposite foot, and therefore can rotate boot attachment member 1 around the opposite half of locking ring 2.

Figure 6B:
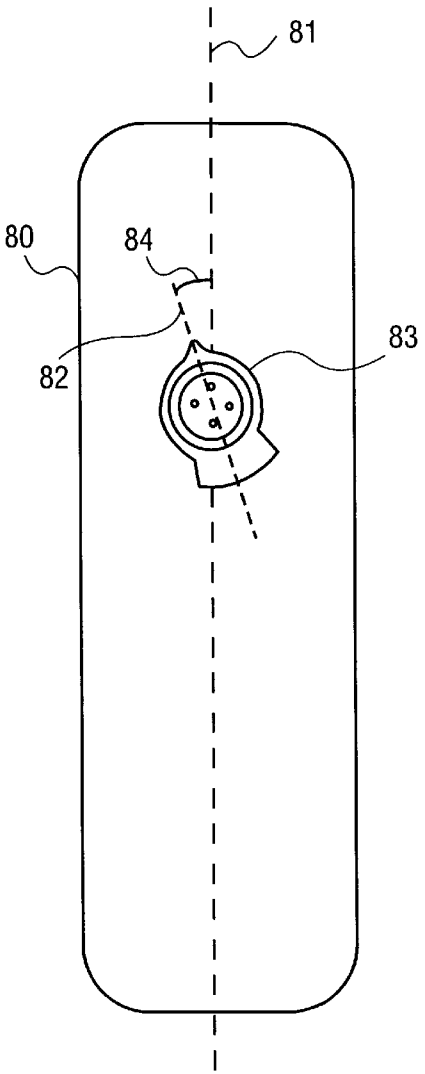
FIGS. 6A and 6B show two different positions of a boot attachment member in accordance with the teachings of the present invention.
Figure 6A:
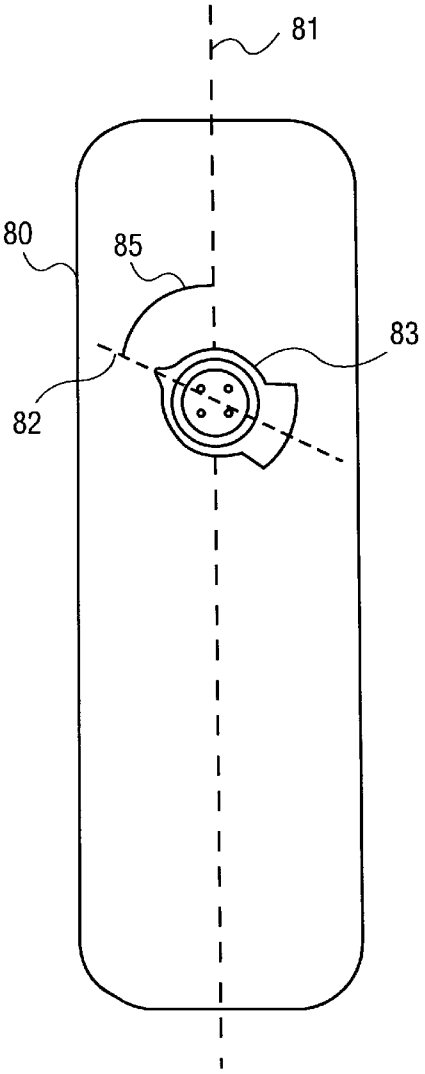

Because locking ring 2 and stopping member 32 are adjustable, as described in more detail below, the initial position of boot attachment member 1 can be the user's ride position, as shown in FIG. 6A, where the user's front boot points primarily to the side of the snowboard. The adjustability of locking ring 2 also allows the intermediate position of boot attachment member 1 to be a more comfortable non-ride position, as shown in FIG. 6B, such that the user's front boot points primarily to the front of the snowboard rather than the side of the snowboard. In such a non-ride position, the user can more easily push himself or herself along flat surfaces with a free back boot. The tasks of mounting and dismounting a ski lift are also made easier. Although the present invention has particular applicability to a snowboard user's front boot, it is appreciated that the present invention is not limited to use with a user's front boot. The fact that the present invention allows the user to rotate boot attachment member 1 without using his or her hands enables the user to quickly transition from a non-ride position to a ride position. This is especially useful after the user dismounts a ski lift or when the user moves from flat terrain to downwardly sloped terrain.

With continued reference to FIG. 1C, an unassembled boot binding according to one embodiment of the present invention is shown. Boot attachment member 1 has a recess 36 that encircles opening 35 in boot attachment member 1. Locking ring 2 has a flange section 99, which extends around part of the circumference of locking ring 2 according to the desired placement of slots 6*a* and 6*b*, which are formed in flange section 99. Flange section 99 terminates at single-angled portions 7*a* and 7*b*. Locking ring 2 has a first planar surface 23 and a second planar surface 24 divided by shoulders 275. Flange section 99 extends above and outward from second planar surface 24. Flange section 99 engages with recess 36 of boot attachment member 1 while the remaining portions of locking ring 2 fit within opening 35. In one embodiment, locking ring 2 is made of anodized aluminum and treated with liquid teflon to facilitate smooth rotation between locking ring 2 and boot attachment member 1. To provide greater wear resistance and smoother rotation, those portions of the boot attachment member 1 that are in sliding contact may be made of titanium nitride. When locking ring 2 is positioned within opening 35 of boot attachment member 1, the top surface of flange section 99 is level with the top surface of boot attachment member 1. First planar surface 23 of locking ring 2 is also level with the surface of recess 36.

A cam 95 has a circular main body 26 that is placed within the center opening 25 of locking ring 2. Cam 95 has an arm 27 that extends outward from main body 26. The bottom of arm 27 has a stepped portion 28, which rests on first planar surface 23 of locking ring 2 when main body 26 is positioned within center opening 25. The distal end 29 of arm 27 is configured to accommodate the attachment of stopping member 32. In one embodiment, double-angled portions 33*a* and 33*b* are identical. In an alternative embodiment, the stopping member has only one double-angled portion adjacent to the stopping portion. Stopping member 32 may be integrally formed with arm 27 of cam 95. The top surface of stopping member 32 is preferably at a slightly higher level than the top surface of cam 95. In one embodiment of the invention, cam 95, stopping member 32, locking ring 2 and securing plate 3 define a positioning assembly of the boot binding. It should be noted that the invention is not limited to a particular positioning assembly design.

Securing plate 3 is placed over locking ring 2 within the boundary defined by flange section 99 such that the bottom surface of securing plate 3 contacts second planar surface 23 and the top surface of cam 95. After securing plate 3 is placed within locking ring 2, the top surface of securing plate 3 is level with the tops of flange section 99 and stopping member 32. When main body 26 of cam 95 is centered within opening 25 (see FIG. 4B), a through path is provided between bolt holes 5 of securing plate 3 and the underlying snowboard (not shown). Once bolted to the snowboard, securing plate 3 provides a downward force to locking ring 2, cam 95 and boot attachment member 1. It is important to note that securing plate 3 should not be screwed down so tightly that the resulting downward force is so large as to prevent boot attachment member 1 from being rotated. The fact that securing plate 3 presses down on second planar surface 24 rather than flange section 99 helps ensure that the downward force of securing plate 3 does not prevent boot attachment member 1 from being rotated. An important feature of the present invention is that the user may adjust the radial position of locking ring 2 and cam 95 prior to affixing securing plate 3 to the snowboard. The radial position of locking ring 2 is selected by rotating locking ring 2 within opening 35 of boot attachment member 1. The radial position of cam 95, and hence, the radial position of stopping member 32, is selected by rotating arm 27 along first planar surface 23 between shoulders 275.

With continuing reference to FIG. 1C, housing 15 is attached to boot attachment member 1 by screws (not shown) that are inserted through pairs of threaded holes 20*a* and 31*a*, 20*b* and 31*b*, and 20*c* (not shown) and 31*c*. A pin 14 inserted through holes 18*a*, 17 and 18*b* rotatably couples release arm 10 to housing 15. A pin 13 rotatably secures release arm 10 to main body 11, which rests within a nook 19 in boot attachment member 1, by being inserted through holes 22*a*, 16 and 22*b*. Boot attachment member 1 is shown having a recess 90 and holes 91 for mounting heel clip 401. A recess 92 and holes 93 are provided for mounting toe clip 402. It is to be understood that the invention is not limited to boot attachment members having such features. In one embodiment, as described more fully below, pads 37 are secured to the bottom of boot attachment member 1.

Figure 2A:
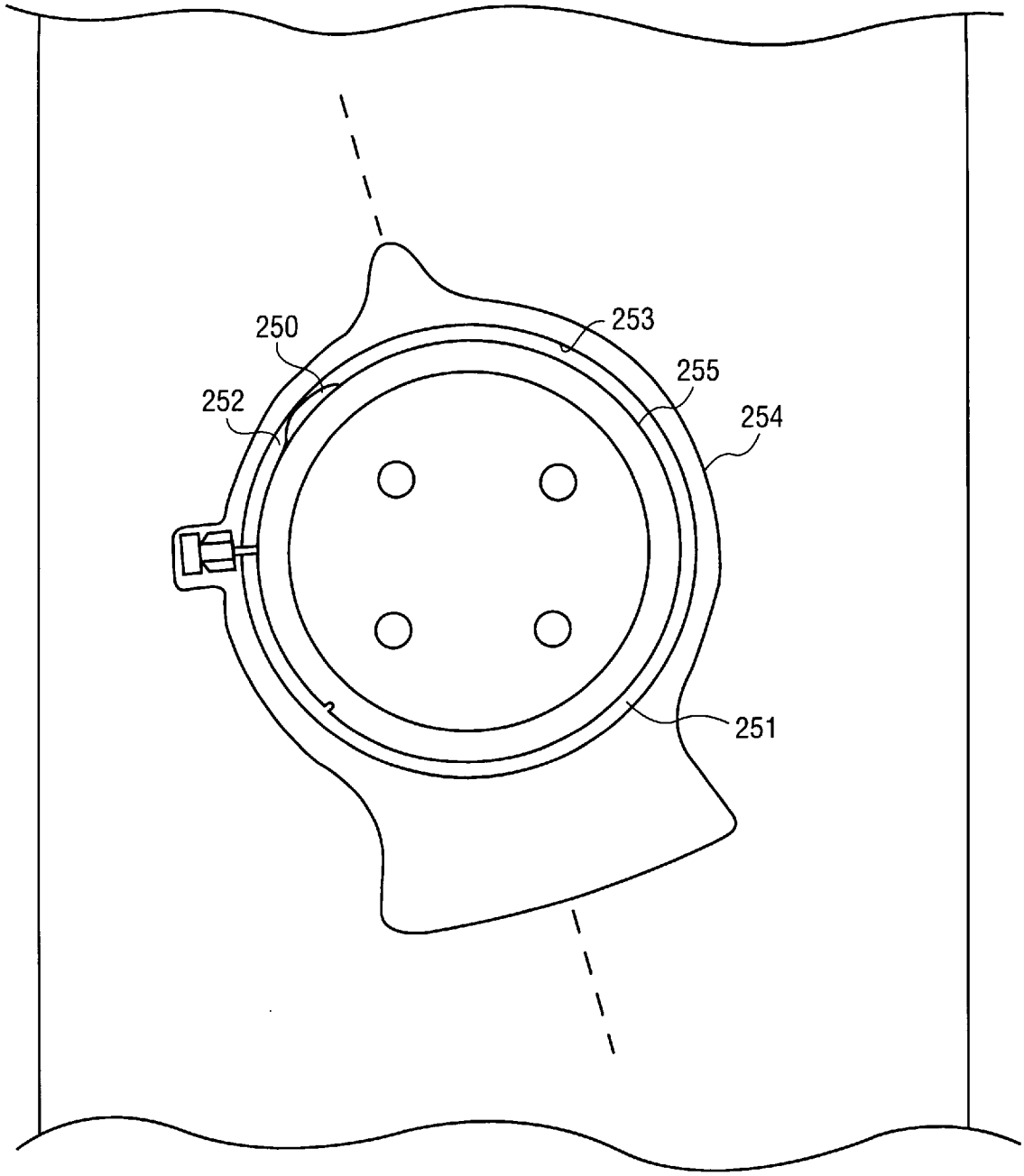
FIGS. 2A and 2B show top views of two positions of an assembled boot binding with an alternative stopping arrangement in accordance with the teachings of the present invention.
Figure 2B:
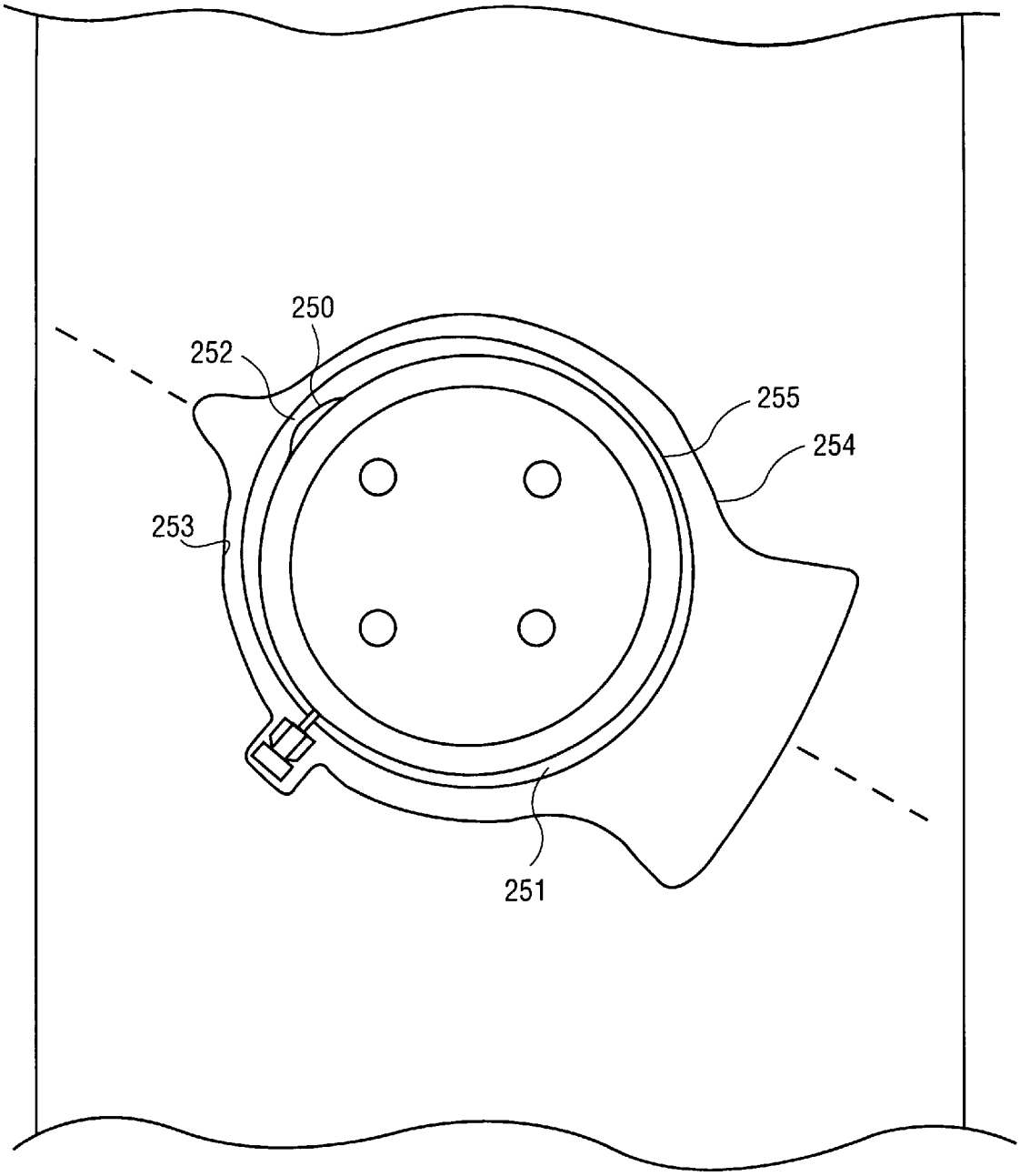

In one embodiment of the invention, as shown in FIG. 2A, a wedge 250 protruding from the edge of locking ring 2 can be used in lieu of the tab-stopping member arrangement of FIGS. 1A–1C to hold a boot attachment member 254 in an intermediate position. In one embodiment, wedge 250 is replaceably attached to the edge of a circular locking ring 255, which is located within an elliptical opening 251 of boot attachment member 254. In another embodiment, wedge 250 is integrally formed with locking ring 255. Wedge 250 can also be located on inner wall 253 of opening 251. As boot attachment member 254 is rotated, gap 252 between wedge 250 and inner wall 253 of elliptical opening 251 decreases until wedge 250 presses against inner wall 253 of elliptical opening 251. Wedge 250 pressing against inner wall 253 is part of a first locking arrangement. The size, shape and material of wedge 250 can be chosen to accommodate the user's preferences regarding the amount and ease of rotation. For example, in one embodiment, the surfaces of wedge 250 and inner wall 253 are textured to adjust the frictional force between contacting surfaces. In another embodiment, wedge 250 is made of metal. In yet another embodiment, the opening in the boot attachment member is circular and the locking ring is elliptical. The wedge and tab-stopping member assemblies are merely illustrative and should not be used to limit the invention in any way. It should be noted that a separate, second locking arrangement, such as the tab-slot locking arrangement described above, is still needed to secure boot attachment member 254 in a locked position, as shown in FIG. 2B.

Figure 3A:
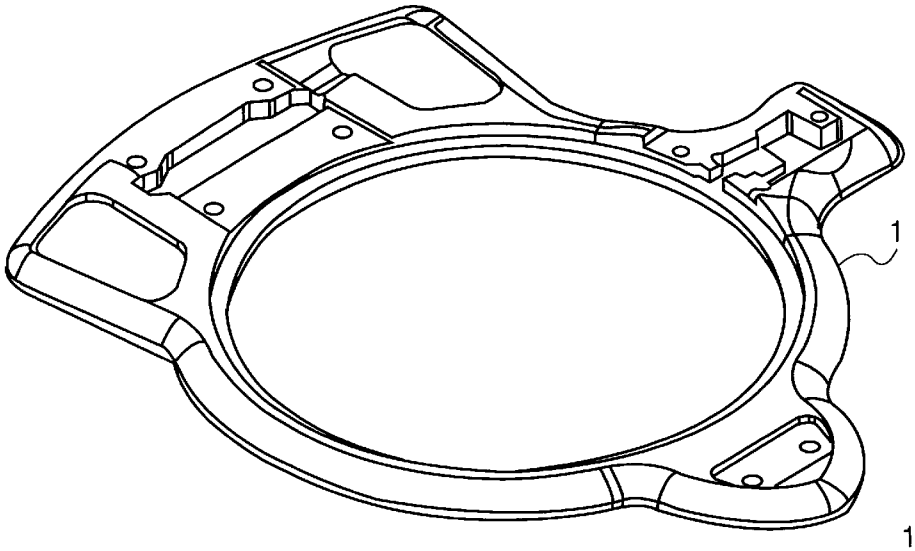
FIGS. 3A and 3B show top and bottom angled views, respectively, of a boot attachment member in accordance with the teachings of the present invention.
Figure 3B:
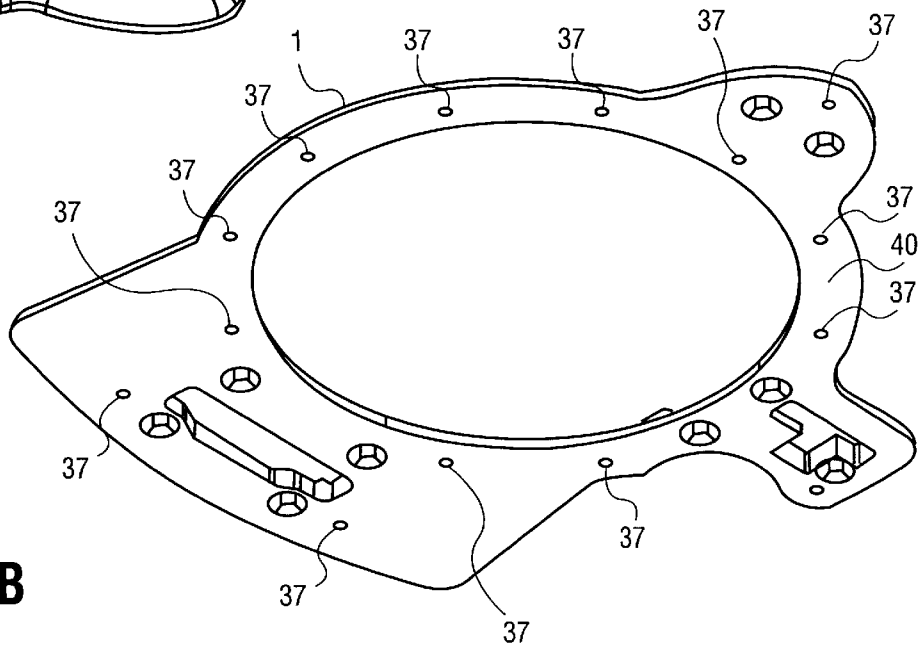

FIGS. 3A and 3B show top and bottom angled views, respectively, of boot attachment member 1. Pads 37 can be placed on bottom surface 40 of boot attachment member 1. Because pads 37 act as spacers between boot attachment member 1 and the underlying snowboard, pads 37 contact the snowboard when boot attachment member 1 is attached to the snowboard. Pads 37 can be nylon or any other suitable material having a surface hardness less than that of the snowboard. This feature inhibits scratching of the snowboard by boot attachment member 1. In one embodiment, pads 37 also provide some cushioning support to the user as he or she stands on and rides the snowboard.

Figure 4A:
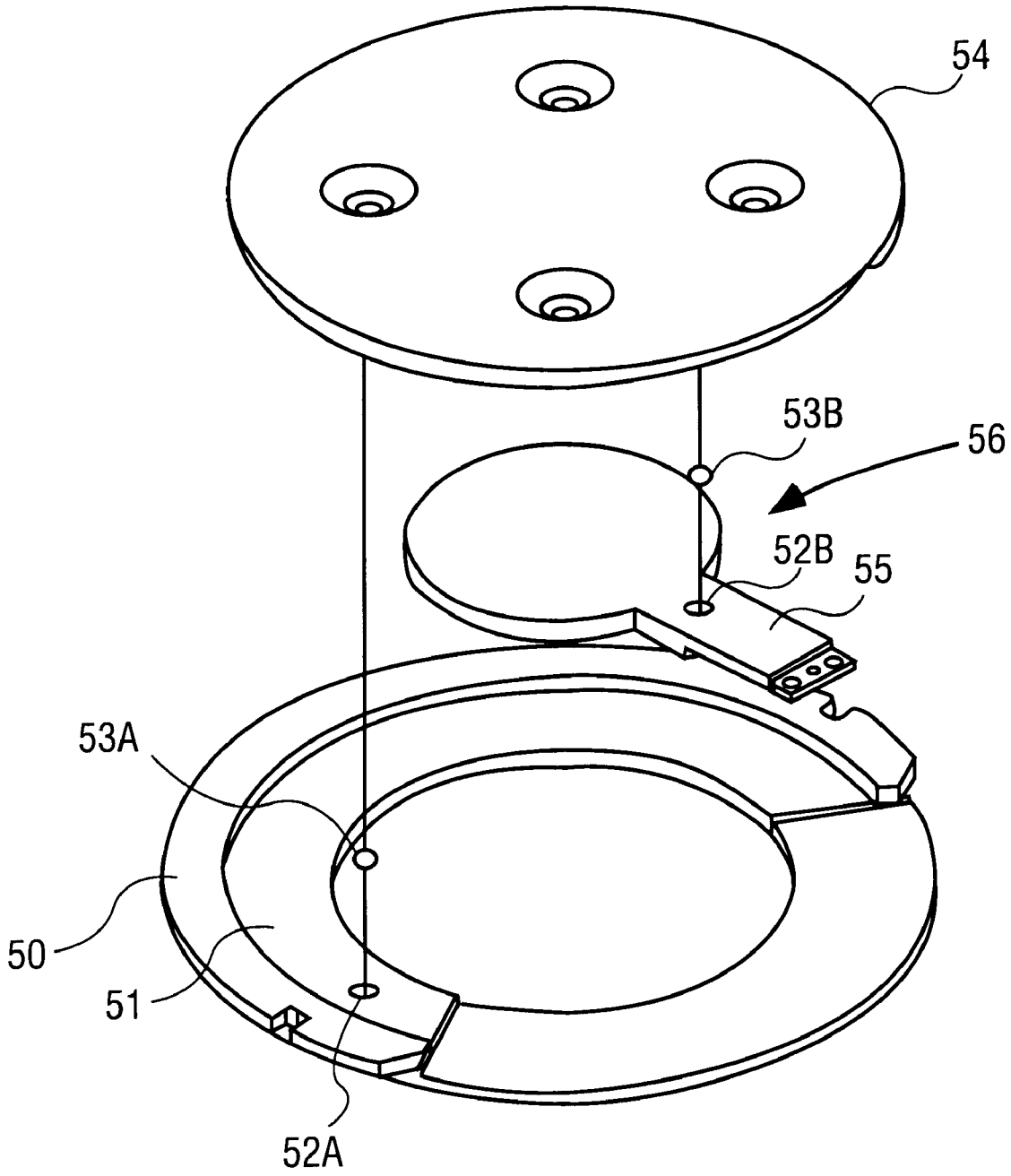
FIGS. 4A and 4B show top and bottom angled views, respectively, of a positioning assembly of a boot binding in accordance with the teachings of the present invention.
Figure 4B:
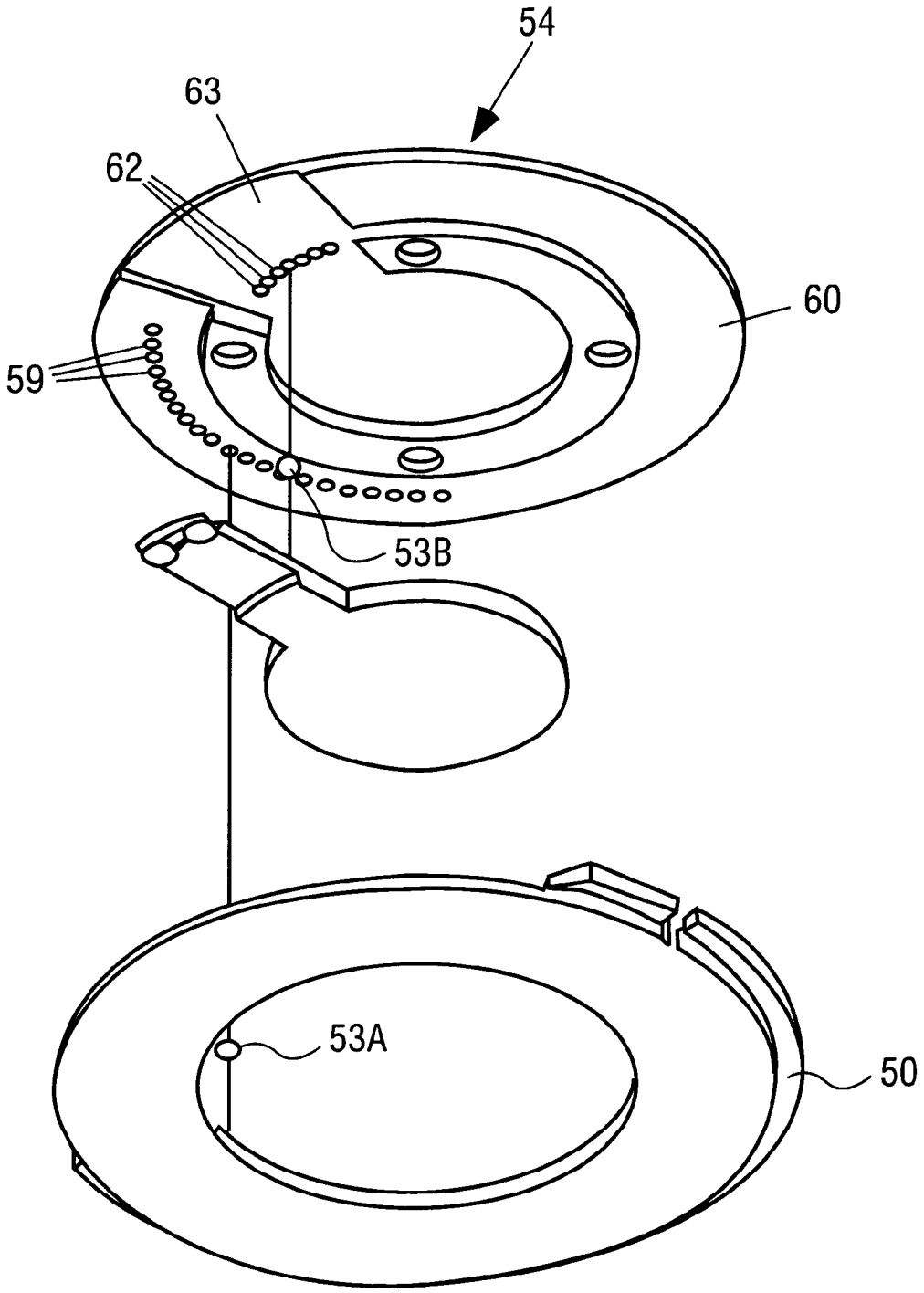

FIGS. 4A and 4B show top and bottom angled views, respectively, of a positioning assembly used in a boot binding according to yet another embodiment of the invention. Second planar surface 51 of locking ring 50 has at least one indentation 52*a* which, in one embodiment, houses a spherical member 53*a* that extends at least partially above second planar surface 51. Arm 55 of cam 56 has an indentation 52*b* which, in one embodiment, houses a spherical member 53*b* that extends at least partially above arm 55. In an alternative embodiment, bumps that extend from second planar surface 51 and arm 55 are used instead of the spherical members. Securing plate 54 has a plurality of indentations 59 and 62 formed on the bottom surfaces 60 and 63, respectively, of securing plate 54. When securing plate 54 is affixed to the underlying snowboard, bottom surface 60 of securing plate 54 presses against second planar surface 51 of locking ring 50 and bottom surface 63 presses against cam 56. Spherical members 53*a*, 53*b* engage one of the plurality of indentations 59 and 62 to prevent locking ring 50 and cam 56 from inadvertently rotating during rotation of the boot attachment member (not shown).

Figure 5A:
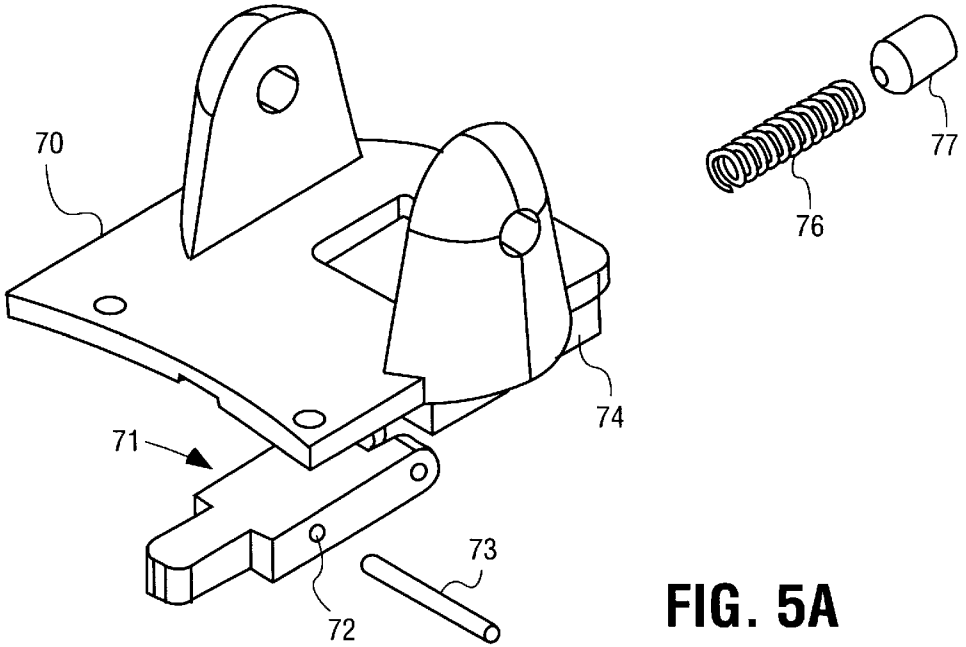
FIGS. 5A and 5B show top and bottom angled views, respectively, of a locking device in accordance with the teachings of the present invention.
Figure 5B:
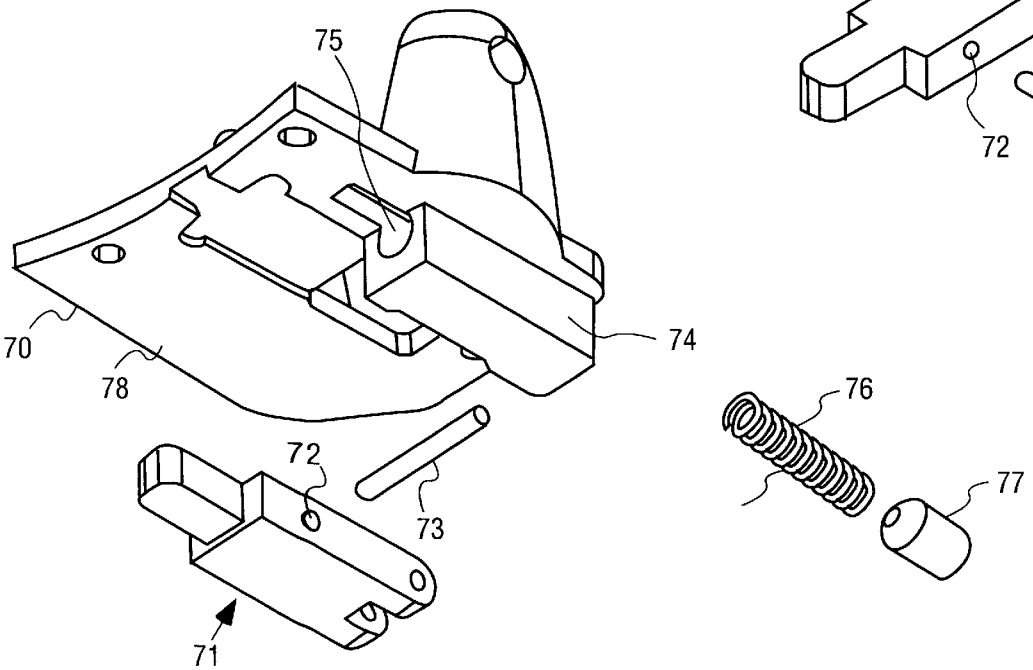

FIGS. 5A and 5B show top and bottom angled views, respectively, of a locking device according to one embodiment of the invention. A main housing 70 has a spring housing 74 formed on a bottom surface 78 of main housing 70. Spring housing 74 has a bore 75 that accommodates a spring 76 and a plug 77, against which spring 76 is compressed. A locking member 71 has a hole 72 into which a pin 73 is inserted. The exposed end of pin 73 is orthogonally impinged upon by the end of spring 76 that is extending out from bore 75. Thus, via pin 73, spring 76 forces locking member 71 into a locked position, as mentioned earlier with reference to FIG. 1A. The position of spring 76, and hence the biasing force provided by spring 76, can be varied according to the placement of plug 77 within bore 75.

FIGS. 6A and 6B show two different positions of a boot attachment member 83 in accordance with the teachings of the present invention. For purposes of clarity, a back boot binding is not shown on snowboard 80. Snowboard 80 has a longitudinal axis 81, and boot attachment member 83 has a boot axis 82, which is aligned with the user's attached boot (not shown). FIG. 6A shows boot attachment member 83 in a ride position, which places the user's front boot at a conventional angle 85 for snowboarding down a slope. The angle 85 between longitudinal axis 81 and boot axis 82 is normally in the range of 40 to 90 degrees when boot attachment member 83 is in a ride position. FIG. 6B shows boot attachment member 83 in a non-ride position. As mentioned earlier, the user can use a non-ride position to place his or her front boot at a more comfortable angle to facilitate movement on flat areas. A non-ride position is also helpful for getting on, sitting on, and getting off ski lifts. The angle 84 between longitudinal axis 81 and boot axis 82 is typically in the range of 0 to 30 degrees when boot attachment member 83 is in a non-ride position. It should be noted that FIGS. 6A and 6B are applicable to users who lead with their right foot. For users who lead with their left foot, the size of the angles are the same, but are simply measured on the opposite side of longitudinal axis 81.

Thus, the present invention provides a boot binding that allows a snowboard user to quickly and easily rotate his or her boot from one position to another position by simply swiveling the boot. This allows the user to place his or her boot at a comfortable angle when not riding the snowboard, while giving the user the ability to rotate the boot to a conventional ride position on the fly, without having to unscrew or unlock the binding or use his or her hands in any way.

In the foregoing detailed description, the present invention has been described with reference to specific exemplary embodiments. However, it will be evident that various modifications and changes may be made without departing from the broader scope and spirit of the present invention. The present specification and figures are accordingly to be regarded as illustrative rather than restrictive.

What is claimed is:

1. A boot binding comprising:

a rotatable boot attachment member;

a first locking arrangement for holding said boot attachment member in a first position, said first locking arrangement being releasable upon the application of only a first force to said boot attachment member to move said boot attachment member from said first position;

a second locking arrangement for locking said boot attachment member in a second position;

a release arm to which a second force can be applied to release said second locking arrangement;

said second locking arrangement comprising a releasable tab engageable with a locking ring;

said first locking arrangement comprising said releasable tab engageable with a stopping member extending from a rotatable arm disposed within said locking ring.

2. A binding as in claim 1 wherein said boot attachment member is movable from said first position to said second position upon the application of said first force to said boot attachment member.

3. A snowboard boot binding comprising:

a rotatable boot attachment member secured to a snowboard;

a first locking arrangement for maintaining said boot attachment member in a first position, said first locking arrangement being releasable upon the application of only a swivel force to said boot attachment member; and a second locking arrangement for locking said boot attachment member in a second position, said boot attachment member being rotatable from said first position to said second position upon the application of said swivel force to said boot attachment member;

said second locking arrangement comprising a releasable tab engageable with a locking ring;

said first locking arranaement comprising said releasable tab engageable with a stopping member extending from a rotatable arm disposed within said locking ring.

4. A binding as in claim 3 further comprising a plurality of pads disposed on a bottom surface of said boot attachment member, said pads contacting the snowboard, said pads having a surface hardness less than the surface hardness of a top surface of the snowboard.

5. A binding as in claim 3 wherein the snowboard comprises a longitudinal axis and said boot attachment member comprises a boot axis, an angle between said longitudinal and boot axes being in the range of 0 to 30 degrees when said boot attachment member is in said first position.

6. A binding as in claim 3 wherein the snowboard comprises a longitudinal axis and said boot attachment member comprises a boot axis, an angle between said longitudinal and boot axes being in the range of 40 to 90 degrees when said boot attachment member is in said second position.

7. A snowboard boot binding comprising:

a boot attachment member secured to a top surface of a snowboard; and a positioning assembly engageable with said boot attachment member, said positioning assembly having a stopping member, said stopping member engageable with a locking member coupled to said boot attachment member, said locking member being releasable from said stopping member upon the application of only a first swivel force to said boot attachment member, said positioning assembly being coupled to the snowboard;

said positioning assembly further having a locking ring, a cam disposed within said locking ring, said stopping member extending from said cam, and a securing plate engageable with said locking ring, said securing plate being coupled to said snowboard such that said securing plate exerts a downward force on said locking ring and said cam.

8. A boot binding as in claim 7 further comprising a plurality of pads extending from a bottom surface of said boot attachment member, said pads contacting said top surface of the snowboard, said pads having a surface hardness less than the surface hardness of said top surface of the snowboard.

9. A boot binding as in claim 7 wherein the position of said cam is adjustable within said locking ring when said downward force of said securing plate is relaxed.

10. A boot binding as in claim 7 wherein the position of said locking ring is adjustable when said downward force of said securing plate is relaxed.

11. A boot binding as in claim 7 further comprising a positioning bump extending from a top surface of said cam, said positioning bump interlocking with one of a plurality of indentations located on a bottom surface of said securing plate.

12. A boot binding as in claim 7 further comprising a positioning bump extending from a top surface of said locking ring, said positioning bump interlocking with one of a plurality of indentations located on a bottom surface of said securing plate.

13. A boot binding as in claim 7 wherein said locking member comprises a moveable protrusion that is biased into a locked position.

14. A boot binding as in claim 13 wherein said protrusion is mateable with a slot located on the periphery of said positioning assembly.

15. A boot binding as in claim 13 wherein said protrusion is slideable into a space in said stopping member when said boot attachment member is rotated by the application of a second swivel force to said boot attachment member.

16. A boot binding as in claim 13 wherein said protrusion is slideable out of a space in said stopping member when said boot attachment member is rotated by the application of said first swivel force to said boot attachment member.

17. A snowboard boot binding comprising:

a boot attachment member secured to a top surface of a snowboard; and a positioning assembly engageable with said boot attachment member, said positioning assembly having a stopping member, said stopping member engaging a locking member coupled to said boot attachment member, said locking member being releasable from said stopping member upon the application of a first swivel force to said boot attachment member, said positioning assembly being coupled to the snowboard, said positioning assembly comprising a positioning bump extending from a top surface of a cam disposed on said top surface of the snowboard, said stopping member extending from said cam, said positioning bump interlocking with one of a plurality of indentations located on a bottom surface of a securing plate being coupled to the snowboard such that said securing plate exerts a downward force on said cam;

said positioning assembly further comprising a locking ring, said cam disposed within said locking ring.

* * * * *